US005299695A

United States Patent [19]

Taylor, Jr.

[11] Patent Number: 5,299,695

[45] Date of Patent: Apr. 5, 1994

[54] CAROUSEL FOR SUPPORTING OIL CONTAINERS

[76] Inventor: Robert Taylor, Jr., 1678 Rotary Dr., Los Angeles, Calif. 90026

[21] Appl. No.: 919,901

[22] Filed: Jul. 27, 1992

[51] Int. Cl.[5] ..... A47B 73/00

[52] U.S. Cl. ..... 211/77; 211/78

[58] Field of Search ..... 211/77, 78, 131, 163; D7/590, 592, 600, 616

[56] References Cited

U.S. PATENT DOCUMENTS

| | | | |
|---|---|---|---|
| D. 189,683 | 1/1961 | Bloomfield | D7/590 |
| D. 256,871 | 9/1980 | Snyder | D7/590 |
| 367,329 | 7/1887 | Witherell | 211/77 |
| 1,878,302 | 9/1932 | Tourtois | 211/77 |
| 1,978,695 | 10/1934 | Clark | 211/77 |
| 2,025,416 | 12/1935 | Limerick, Jr. | 211/77 |
| 2,042,637 | 6/1936 | Scurlock | 211/77 |
| 2,052,801 | 9/1936 | Russakov | 211/77 |
| 2,468,000 | 4/1949 | Taylor | 211/77 |
| 2,539,600 | 1/1951 | Waits | 211/77 |
| 3,417,873 | 12/1968 | Leptrone | 211/77 |
| 4,438,853 | 3/1984 | Numbers | 211/77 |
| 4,485,997 | 12/1984 | Potter | 211/163 |
| 4,775,055 | 10/1988 | Morse | 211/77 |
| 5,183,165 | 2/1993 | Acona et al. | 211/77 |

*Primary Examiner*—Paula A. Bradley
*Assistant Examiner*—Erik R. Puknys

[57] ABSTRACT

A carousel is disclosed herein for supporting a plurality of cooking oil containers having outwardly projecting spouts and handles wherein the carousel includes a hollow turntable reinforced with a circular support rib and having an upper surface provided with separate and individual receptacles for receiving the bottom of each container. The receptacles are critically disposed with respect to each other so as to accommodate placement of the containers on the turntable so that the spouts and handle do not extend beyond the peripheral edge thereof. A base with a bearing rotatably supports the turntable.

1 Claim, 2 Drawing Sheets

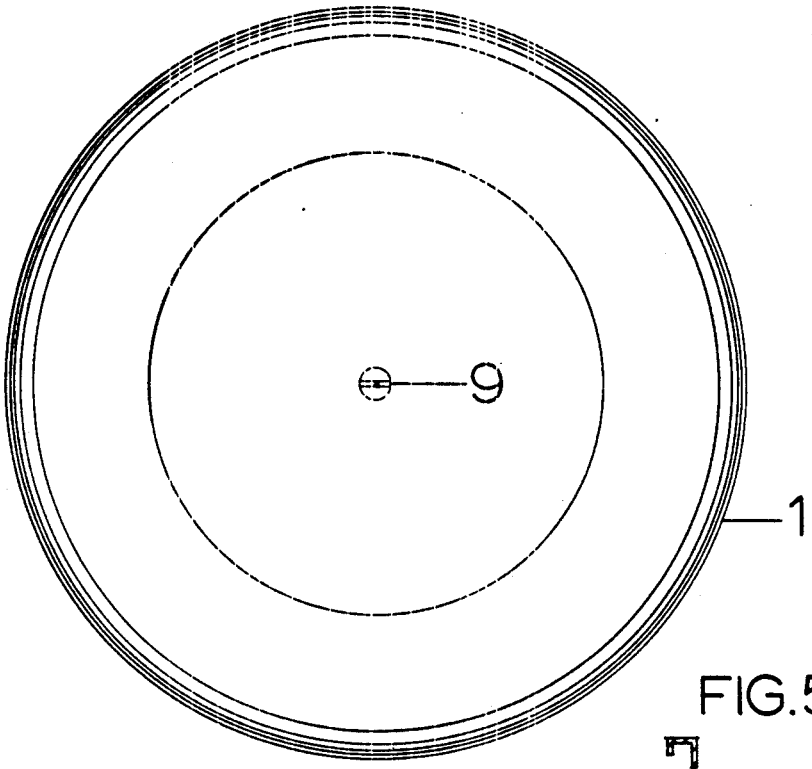
FIG.4
FIG.5
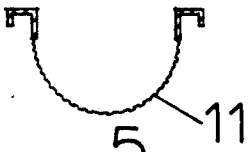
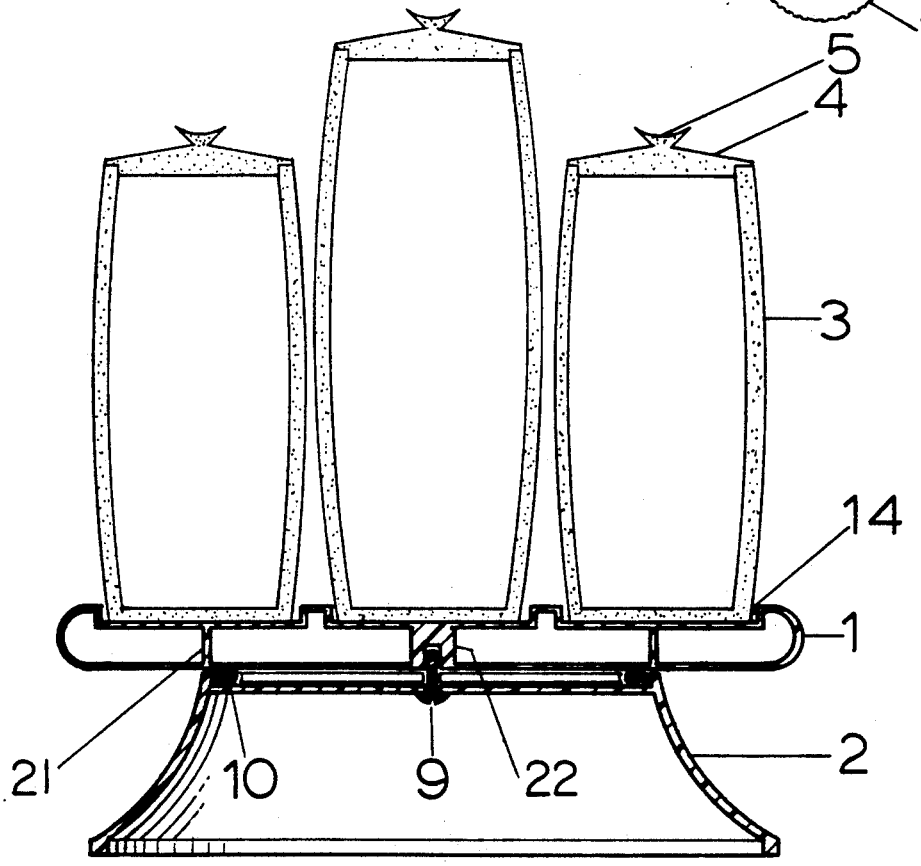
FIG.3

CAROUSEL FOR SUPPORTING OIL CONTAINERS

BACKGROUND OF THE INVENTION

1. Field of the Invention

The present invention relates to the field of carousels for tabletop use, and more particularly to a novel carousel having a lightweight, hollow turntable provided with a plurality of container recesses arranged in a particular pattern so as to accommodate spouts and handles carried on each of the respective containers.

2. Brief Description of the Prior Art

In the past, it has been the conventional practice to provide a carousel or, as commonly referred to as "a lazy-Susan" wherein the turntable is made of a heavy material so as to support containers on top of the turntable and wherein the turntable can be rotated so as to place a preferred container in a front position for handling by the user. In constructing the turntable, the containers are sometimes carried between a peripheral barrier. However, problems and difficulties have been encountered which stem largely from the fact that each of the respective containers may include a spout and a handle so that when the plurality of containers are placed in juxtaposition, the handles and spouts project beyond the peripheral edge of the turntable and, in some instances, prevent a full plurality of containers from being carried on the turntable. In other words, the outwardly projecting spouts and handles interfere with adjacent containers so that the full plurality of containers cannot be readily accommodated on the surface of the turntable. In other instances, problems have been encountered because the turntable is extremely heavy and this has a tendency to wear out the bearings separating the underside of the turntable with a supporting pedestal or base.

Therefore, a long-standing need has existed to provide a novel carousel wherein the plurality of containers having handles and spouts may be placed in juxtaposition so that all of the containers can be accommodated on the surface of the turntable. Furthermore, the turntable should be made of lightweight construction and design so that the unit will last longer and provide good service. Furthermore, it is intended that the contents of the container be of a cooking oil product or substance so that a plurality of cooking oil products may be preserved and contained for future use by a cook or household person. Each of the containers should contain a removable lid so that used oil product may be placed into the container and a separate strainer may be kept nearby so that the used oil can be strained for later use.

SUMMARY OF THE INVENTION

Accordingly, the above problems and difficulties are obviated by the present invention which provides a novel carousel having a lightweight, hollow turntable carried by suitable bearings on a raised pedestal or base. The hollow turntable includes a circular reinforcing rib so as to support the weight of a plurality of oil-filled containers carried on the turntable. The upper surface of the turntable is provided with a plurality of receptacles or recesses adapted to support the plurality of oil containers in a particular pattern so that respective spouts and handles carried on each of the containers will not interfere with adjacent containers and will not project beyond the peripheral edge of the turntable.

Therefore, it is among the primary objects of the present invention to provide a novel carousel for a plurality of containers holding used cooking oils which allows the user to maintain the cooking oils in a position for repeated selection of the oils when reused.

Still another object of the present invention is to provide an oil carousel which maintains cooking oils fresh with a safety sealed top and which provides a means for straining the used oil prior to future use.

Yet another object of the present invention is to provide a novel cooking oil carousel which automatically filters the oil with a very fine filter removing unwanted food particles such as flour, cornmeal, etc., so that only good cooking oil remains in the oil container.

Yet another object of the present invention is to provide a novel cooking oil storage system employing a carousel with a turntable having means for supporting cooking oil storage cans so that handles and spouts of each container do not interfere with adjacent containers and do not extend beyond the peripheral edge of the turntable.

Still a further object of the present invention is to provide a novel cooking oil carousel which includes a lightweight and hollow turntable reinforced by a circular rib whereby a plurality of containers for respective cooking oils is adequately supported.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 3 is a transverse cross-sectional view of the carousel shown in FIG. 1;

FIG. 4 is a bottom view of the carousel shown in the figures.

DESCRIPTION OF THE PREFERRED EMBODIMENT

Figure 2:
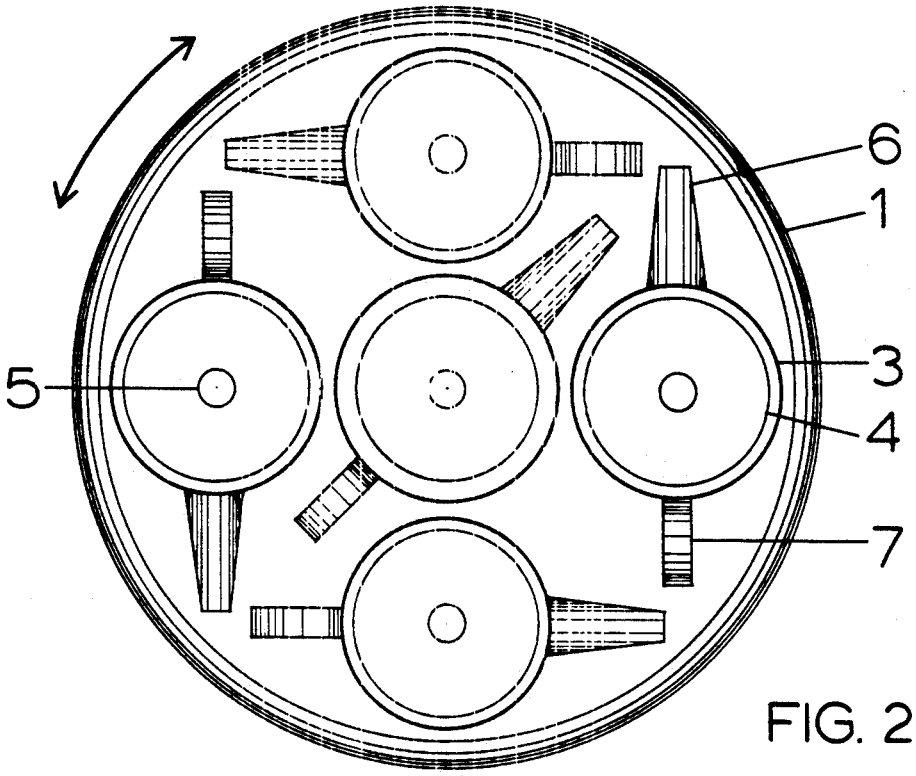
FIG. 2 is a top plan view of the cooking oil carousel shown in FIG. 1.
Figure 1:
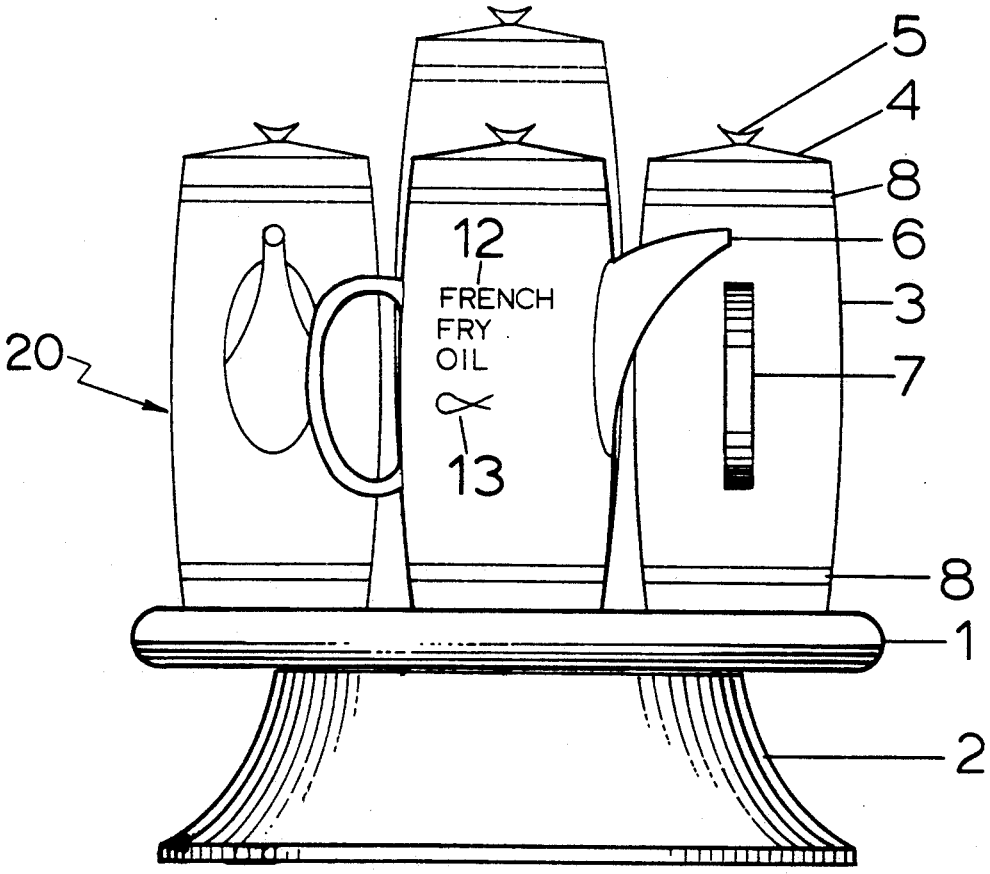
FIG. 1 is a front elevational view of the novel cooking oil carousel of the present invention.

Referring to FIG. 1, the novel carousel device or apparatus of the present invention is illustrated in the general direction of arrow 20, which includes a turntable 1 rotatably carried on an upright pedestal or base 2. A plurality of containers, such as container 3, is carried on the upper surface of the platform 1. Each of the respective containers includes a lid 4 having a handle 5 which may be removed by the user when it is desired to introduce a cooking oil into the interior of the container. Decorative stripes represented by the numeral 8 may be placed on the top and bottom of each container and outwardly projecting spouts 6 and handles 7 are also carried on each container. When it is desired to pour a contained cooking oil from an individual container, the user may grasp the handle 7, lift it from the turntable 1 and then pour the oil from the spout 6 through a filter 11, as shown in FIG. 5. The filter may be carried on the spout 6 internally or a handle filter may be used and stored separately external of the apparatus.

Numerals 12 and 13 represent indicia which may be placed on the external surface of each container so as to identify its contents. For example, numeral 12 indicates that French fry oil is contained within the container and numeral 13 indicates a logo or other advertising indicia.

Referring now in detail to FIG. 5, it can be seen that the turntable 1 has a given diameter terminating in a circular peripheral edge and that the containers, such as container 3, are supported on the top surface of the turntable and that none of the handles nor spouts extend beyond the peripheral edge. Additionally, the containers are arranged in such a fashion that the respective spouts and handles do not interfere with adjacent ones of the containers so that the pattern or layout of the containers on the turntable top surface is critical.

Referring now in detail to FIG. 3, it can be seen that the top surface of the turntable 1 includes a plurality of recesses, such as recess or receptacle 14, for supporting the bottom of the respective container, such as container 3. Therefore, the arrangement of the receptacles determines the location of each of the respective containers so that the pattern or layout of the receptacles is critical so as to prevent interference of the handles and spouts with adjacent containers. Also, it is to be noted that the lid 4 is removably placed on top of the container and that preferably, the sidewalls of the containers are composed of an insulative material so as to maintain the oil heated when it is poured or placed into the container and therefore, it will not rapidly cool.

FIG. 3 also discloses that the turntable 1 is hollow so as to be of reduced weight and that the upper surface of the turntable containing the receptacles 14 is supported by a circular sidewall, indicated by numeral 21, and by a central post 22. The central post includes a pivot 9 which pivotally joins the pedestal or base 2 with the underside of the turntable 1. Bearings, indicated by numeral 10, also support the turntable so that it will move with ease on top of the pedestal 2. Therefore, the pedestal or base 2 is attached to the turntable by the pivot 9 and the turntable is movable on the bearing 10.

FIG. 4 illustrates the underside of the pedestal and the turntable to show the symmetrical construction of the base with respect to the turntable.

In view of the foregoing, it can be seen that the saving of cooking oil is accommodated by the present invention since cooking oil of different types may be put into different containers. At the will of the user, the turntable can be rotated on the pedestal 2 until the desired container of cooking oil is in the forefront. The user can now grasp the container by its handle and the content oil can be poured through the strainer 11 into a cooking vessel. At the conclusion, the container is returned to its receptacle on the turntable. At the end of the cooking procedure, the user may take remaining cooking oil from the pan and re-introduce it back into the storage container. This may be done through the filter 11, if desired.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. In combination;

a carousel for supporting a plurality of cooking oil containers comprising;

a base;

a turntable;

rotation means interconnecting said turntable on saide base;

said turntable being hollow having a top member and a bottom member separated by a cavity and joined by a peripheral edge;

reinforcement means disposed between said top and said bottom means consisting of a central post and a circular rib integrally carried on said top member coaxially disposed with respect to said central post;

said top member having a plurality of receptacles arranged in a predetermined pattern between said peripheral edge thereof and said central post;

said predetermined pattern of said receptacles includes at least five receptacles having a center receptacle disposed over central post and said other receptacles disposed over said rib and between said center receptacle and said peripheral edge;

a plurality of containers each container having a spout and a handle outwardly projecting from a hollow body;

each of said container being supported in its respective receptacle such that said handles and spouts are in non-interfering relationship with respect to adjacent containers and said handles and spouts being within said peripheral edge.

* * * * *